US007481144B2

(12) United States Patent
Simula et al.

(10) Patent No.: US 7,481,144 B2
(45) Date of Patent: Jan. 27, 2009

(54) VIBRATORY COUNTERMINE SYSTEM AND METHOD

(75) Inventors: Glen Raymond Simula, Hancock, MI (US); Steven John Tarnowski, Calumet, MI (US)

(73) Assignee: GS Engineering, Inc., Houghton, MI (US)

( * ) Notice: Subject to any disclaimer, the term of this patent is extended or adjusted under 35 U.S.C. 154(b) by 402 days.

(21) Appl. No.: 11/283,002

(22) Filed: Nov. 18, 2005

(65) Prior Publication Data

US 2008/0092725 A1 Apr. 24, 2008

(51) Int. Cl.
*F41H 11/16* (2006.01)

(52) U.S. Cl. ..... 89/1.13; 102/403

(58) Field of Classification Search ..... 89/1.13; 102/402, 403

See application file for complete search history.

(56) References Cited

U.S. PATENT DOCUMENTS

| | | | | |
|---|---|---|---|---|
| 4,224,003 | A | 9/1980 | St. Louis | |
| 4,411,081 | A | 10/1983 | King | |
| 4,732,507 | A | 3/1988 | Artzberger | |
| 4,759,659 | A | 7/1988 | Copie | |
| 4,909,128 | A | 3/1990 | Grinwald | |
| 4,913,581 | A | 4/1990 | Weiler | |
| 4,919,034 | A | 4/1990 | Firth | |
| 5,007,325 | A | 4/1991 | MacWatt | |
| 5,149,225 | A | 9/1992 | Artzberger | |
| 5,198,608 | A | 3/1993 | Cahill et al. | |
| 5,373,774 | A | 12/1994 | Akbar | |
| 5,712,441 | A | 1/1998 | Grunewald | |
| 5,844,160 | A | 12/1998 | Cieszkiewicz | |
| 5,988,037 | A | 11/1999 | Haughom et al. | |
| 6,026,135 | A | 2/2000 | McFee et al. | |
| 6,134,966 | A | 10/2000 | Donskoy et al. | |
| 6,371,001 | B1 | 4/2002 | Schmid | |
| 6,382,069 | B1 | 5/2002 | Haughom et al. | |
| 6,661,524 | B2 | 12/2003 | Smith et al. | |
| 6,802,237 | B1 | 10/2004 | Jones et al. | |
| 2003/0145716 | A1 * | 8/2003 | Dixon | 89/1.13 |
| 2003/0145717 | A1 * | 8/2003 | Yamamoto et al. | 89/1.13 |
| 2004/0159060 | A1 | 8/2004 | Giri et al. | |
| 2005/0115388 | A1 | 6/2005 | Lowery et al. | |

FOREIGN PATENT DOCUMENTS

| | | | |
|---|---|---|---|
| GB | 2 132 567 A | * | 7/1984 |
| GB | 2 201 643 A | | 9/1988 |
| WO | WO 93/15373 | * | 8/1993 |
| WO | WO 02/01008 A1 | | 1/2002 |

* cited by examiner

*Primary Examiner*—Stephen M Johnson
(74) *Attorney, Agent, or Firm*—Brooks Kushman

(57) ABSTRACT

A vibratory countermine system and method associated with a propulsion means. The system is comprised of a ground-contacting percussion system assembly that is mounted to the front of the propulsion means. Also, a vibratory subassembly is mounted inside the ground-contacting percussion assembly for inducing vibrations in the ground. The ground-contacting percussion system is in contact with the ground ahead of the propulsion means. It transmits the vibrations, associated forces, and pressure waves below or ahead of the countermine system through the ground, thereby inducing the detonation of land mines.

19 Claims, 7 Drawing Sheets

VIBRATORY COUNTERMINE SYSTEM AND METHOD

BACKGROUND OF THE INVENTION

1. Field of the Invention

This invention relates to a system and method for clearing mines using one or more ground-contacting percussion means that operate under the influence of a vibratory stimulus.

2. Background Art

One predominant method of mine-clearing relies on the M1 Abrams battle tank or a similar propulsion means. Such propulsion means can be equipped with a mine plow and mine roller attachments if needed. Other types of mine-clearing systems are either remote-controlled or manned. Mechanical mine-clearing systems are the most prevalent. They include various types, such as the flail, earth tillers, rollers, chains, pads, pedestals and plows—collectively termed herein as "ground-contacting percussion means".

A typical "flail" system has a rotating shaft that extends from the front of the mine-clearing propulsion means. The rotating shaft incorporates flexible members that radiate outwardly from the shaft to beat the ground as the shaft rotates. Adjacent ground-beating members are typically offset angularly from one another around the shaft for improved ground coverage. Flail systems have achieved greater success than tilling devices, but have flaws. These machines are large, expensive, and difficult to maintain. Maintenance costs are high, since chains or other ground-beating members are usually destroyed by landmines and must be replaced frequently. Also, some hardened blast-resistant mines as well as mines with very small pressure plates are able to survive a flail system unless they come in direct contact with the flail.

Earth tillers are another common type of mine-clearing device. They employ one or more rotating horizontal drums with special metal teeth (similar to a rock crusher) mounted on their circumferences, capable of tilling the soil to a variable depth. Such devices use speed, impact, and mass to destroy mines as they move on the field. They can be mounted on a prime mover such as a mine-hardened vehicle. But these machines are large and some weigh as much as 45 tons.

Mine rollers are usually pushed or pulled over terrain by a vehicle or another vehicle with the intent that the pressure exerted by their weight will detonate landmines. Rollers are effective for clearing roads that are suspected of mine contamination. Typical systems tend to be very heavy and require a powerful prime mover. They are fairly effective, except on undulating or stony ground, or heavily vegetated areas. Current systems are very large, expensive, and heavy. This reduces the agility, transportability, and efficiency of deployed units.

These, among other conventional mine countermeasures, require significant tractive effort, thus forcing them to rely on large prime movers such as tanks, or even requiring the use of specialized vehicles.

Among the art identified in a preliminary search conducted before filing this patent application are the following references: U.S. Pub. No. 2003/0145716; U.S. Pat. Nos. 6,382,069 and 6,371,001.

SUMMARY OF THE INVENTION

Against this background, it would be desirable to deploy a mobile, lightweight mine clearing system that is readily transportable, yet has increased mission effectiveness. To increase mission effectiveness, a desirable propulsion means will be self-protective as well as mine-clearing capable.

Another object of the invention is to provide a low-cost, self-contained system that will be affordable in third-world countries. Preferably, the system could be pushed by a security vehicle, a person, dilapidated commercial trucks, or even oxen—termed collectively herein as "propulsion means".

The invention includes a vibratory countermine ground-contacting percussion system which is associated with a propulsion means that moves the ground-contacting percussion system forwardly. A vibratory subassembly is positioned inside the ground-contacting percussion system for inducing vibrations therein. Thus, the ground-contacting percussion system is in contact with the ground ahead of the propulsion means. It transmits vibrations, associated forces, and pressure waves below or ahead of the ground-contacting percussion system through the ground, thereby inducing the detonation of landmines.

A feedback control system, in one embodiment, is used to optimize the angle of attack of a vibratory subassembly. the feedback control system will also optimize the magnitude and frequency of the vibratory excitations to maximize their transmissibility into the soil and increase the stand-off distance for mine detonation.

The invention offers an optimized lightweight mine-clearing solution that is modular, scalable and adaptable to a wide variety of future and existing vehicle platforms. A lightweight system allows medium and light tactical vehicles such as the HMMWV or FMTV platforms to conduct mine-clearing operations, thus increasing their mission effectiveness and expanding their mission capability.

In addition to being lightweight and modular, the invention increases mine blast survivability and durability by increasing the stand-off distance from detonated mines. This is achieved by the disclosed technique for mine neutralization, coupled with the use of advanced materials to provide increased toughness.

Future requirements demand that a countermine system be operated by a 20-ton vehicle, not a 70-ton M1 variant, as is done today. By significantly improving the mine-clearing capabilities of ground forces, an "Assured Mobility" operational approach will be greatly enhanced.

Apart from the desirability of clearing land mines, the disclosed system may be used to improve the condition and driveability of temporary roads.

DETAILED DESCRIPTION OF THE PREFERRED EMBODIMENT(S)

The invention includes a ground-contacting percussion system such as a drum (FIGS. 1-8) or a pad (FIGS. 9-10) that is mounted to the front of a wheeled or tracked vehicle or other propulsion means. Inside the ground-contacting percussion system is an internal, powered vibratory system that induces vibrations in the ground-contacting percussion system. Preferably, the vibratory system induces the vibrations along a non-vertical (inclined) axis. The ground-contacting percussion system (1) remains in substantial contact with the ground ahead of the propulsion means; and (2) transmits these vibrations, associated dynamic forces, and pressure waves ahead and through the ground to induce the detonation of land mines. The land mines will be detonated at a much greater distance than if a non-vibrating roller were used.

Figure 1:
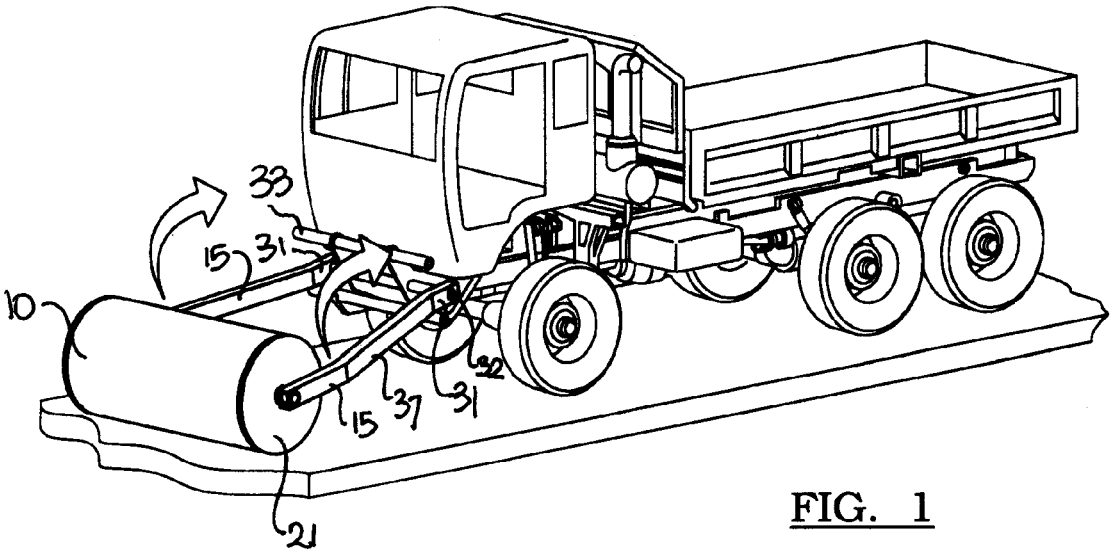
FIG. 1 is a quartering perspective depiction of an embodiment of the invention.

FIG. 1 shows the countermeasure system installed at the front of an FMTV 5-ton dump truck—one example of a "propulsion means". The ground-contacting percussion system is in contact with the ground ahead of the propulsion means. It is mounted preferably on a high-strength, lightweight frame, supported by several bearings. The ground-contacting percussion system is attached by the frame to the propulsion means that is pushing it forward along the ground.

In the area where the propulsion means is attached to the frame, the frame is coupled with a means for articulation to allow rotation and movement of the entire ground-contacting percussion system through bearings or revolute joints. This freedom of movement allows the ground-contacting percussion system to maintain continuous or intermittent contact with the ground over varying terrain. The disclosed system preferably includes bump stops 33 and/or shock absorption devices (collectively "bump stops") that constrain arcuate movement of the frame to minimize damage to the propulsion means. Similarly, the supporting frame in some embodiments is retractable through means 37 for retracting the frame that uses one or more hydraulic or electric actuators to retract and stow the frame system. In that position, the ground-contacting percussion system can be stowed while navigating rough terrain or obstacles, or at high speeds during road travel.

Figure 2:
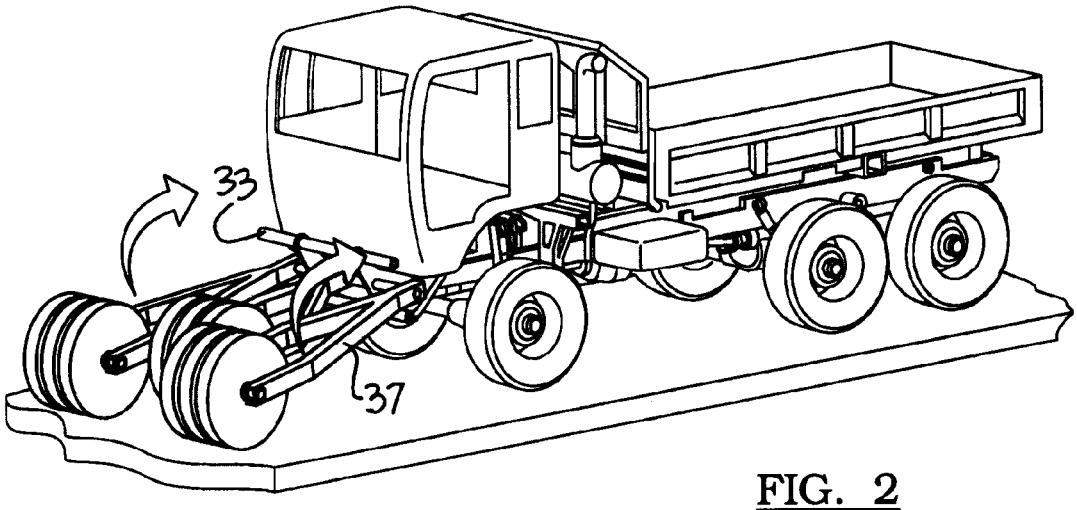
FIG. 2 is an alternate embodiment thereof.

The embodiment of ground-contacting percussion system depicted in FIG. 1 is a roller system. An alternate design configuration incorporates multiple rollers including one or more banks thereof that are free to move independently of each other (FIG. 2). This allows improved mine-clearing coverage and better mobility over uneven or undulating terrain.

Figure 3:
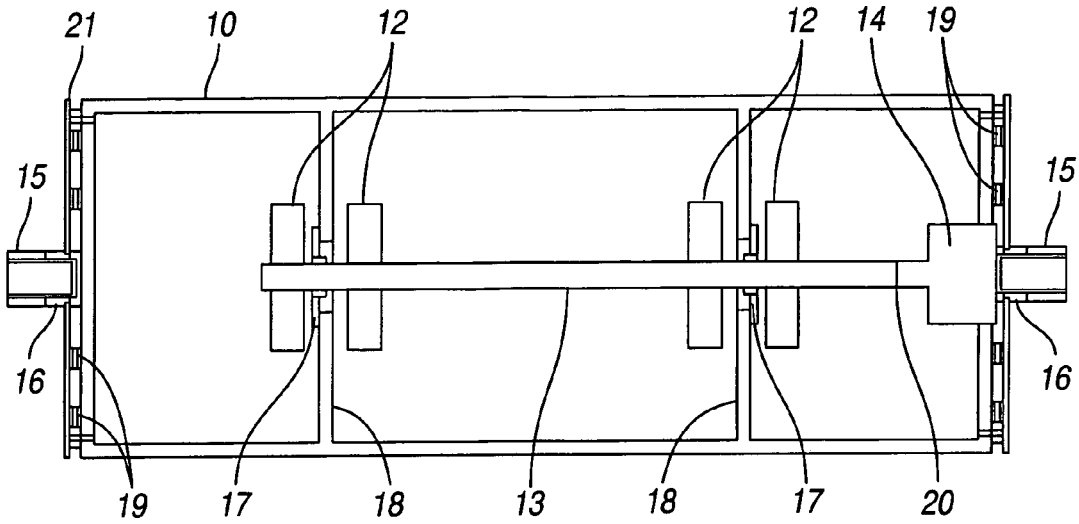
FIG. 3 is a cross-sectional view of a vibratory mine roller.

Reference is now made to a vibratory soil compactor that is used as a mine roller of the type depicted in FIG. 3. In that figure, a roller 10 houses eccentric weights 12 that are mounted on a rotating shaft 13 that is turned by a rotary motor/actuator 14. A support arm 15 is located at either end of the roller 10. A roller bearing 16 is provided around the ends of the roller 10. Another bearing system 17 is provided to support the rotating shaft 13. Those bearings 17 are supported by one or more internal structural ribs 18.

One consequence is that mines detonated by such system are only detonated when the vibrating systems are on top of the mine or quite close to it. This has the effect of tending to damage the ground-contacting percussion system, the support arms, the propelling vehicle, and/or occupants thereof.

Vibration isolators 19 are provided at either or both ends of the roller 10. Flexible motor couplings 20 are provided in cooperation with the rotating shaft 13. Conventionally, end plates 21 also are situated at each end of the roller 10. Most of the energy dissipated by such systems is directed downwardly into the ground—not forwardly.

Figure 4:
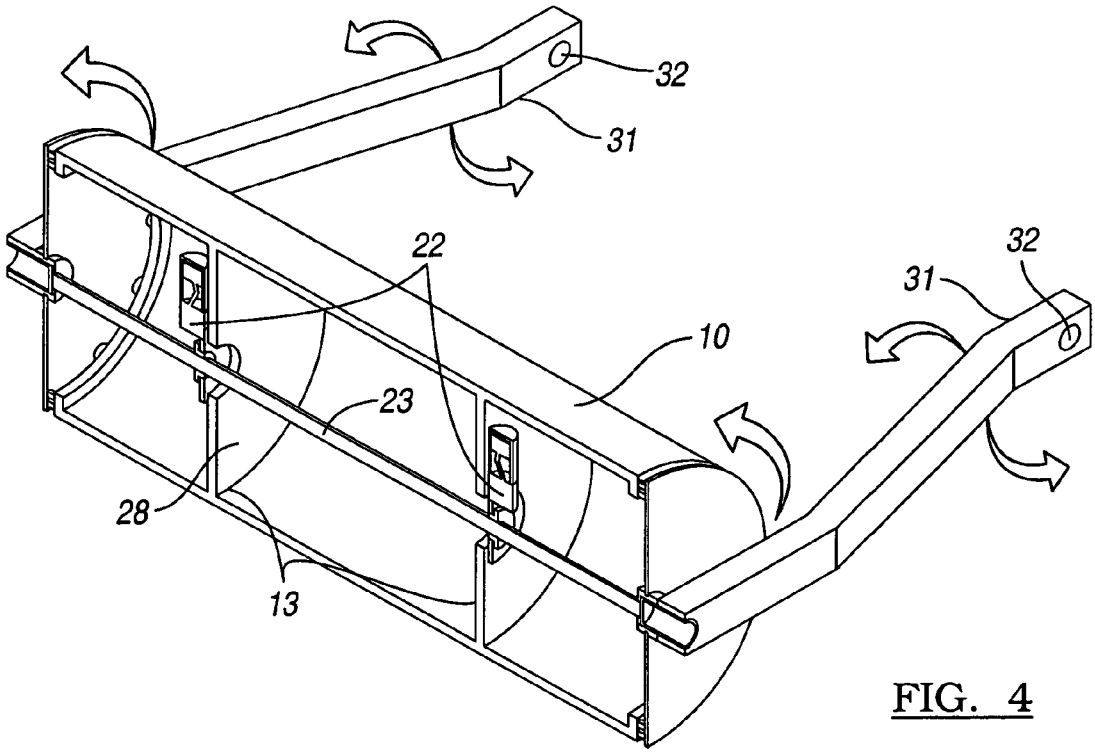
FIG. 4 is a cut-away view of one embodiment of a vibratory mine roller according to the present invention.
Figure 5:
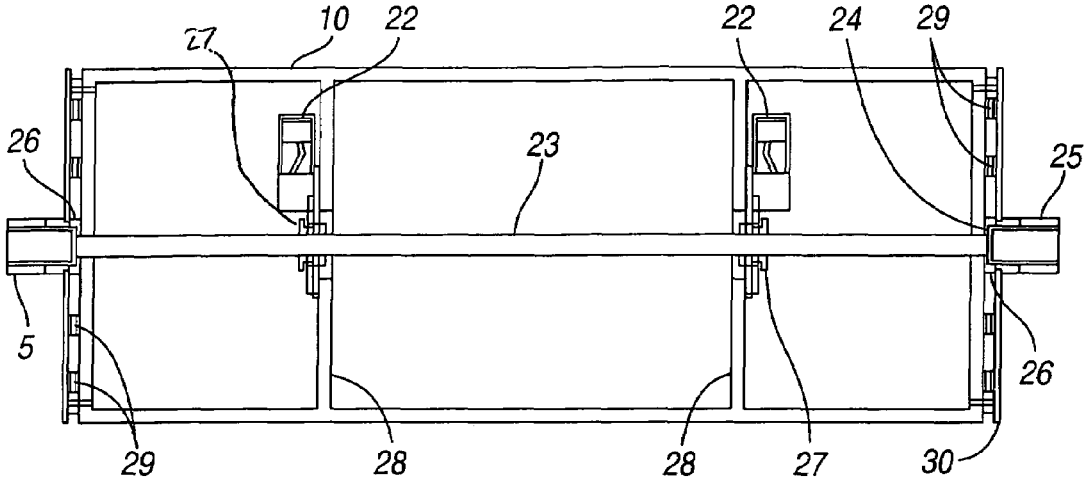
FIG. 5 is a cross-sectional view of the embodiment depicted in FIG. 4.
Figure 6:
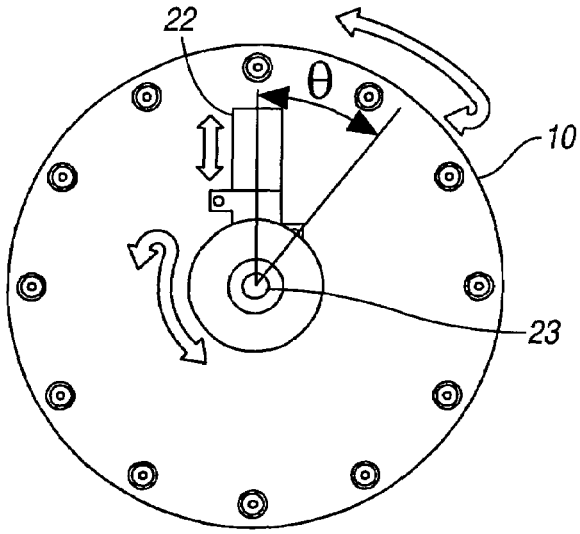
FIG. 6 is a schematic end view thereof.

FIGS. 4-6 represent views of one embodiment of the present invention. In that FIG. 4, the disclosed vibratory countermine ground-contacting percussion system is depicted in isolation from a source of motive force that propels it forwardly. In FIG. 4, frame members 31 link the roller 10 to the propulsion means through support arm pivots 32. Conventionally, vibration isolators 29, and end plates 30 are provided, similarly to those depicted in FIG. 5. The vibratory countermine roller assembly includes a roller assembly 10 that is mounted on an adjustable mounting shaft 23. A vibratory subassembly or reciprocating actuators 22 are arcuately positioned in relation to associated internal structural ribs 28. The vibratory subassemblies can be moved arcuately in relation to a frame of reference such as the supporting members 31, as depicted by the angle θ (FIG. 6).

One consequence of displacing the vibratory subassemblies arcuately is that vibrations can be directed forwardly and downwardly to the ground. As a result, landmines can be detonated distances ahead of the vibratory countermine ground-contacting percussion system. As a consequence, the system, the propulsion means, and its occupants tend to be shielded in what might otherwise be a direct hit.

The internal vibratory mechanism 22 is powered by various alternate means, including reciprocating actuators (as shown in FIGS. 4-6), or electric or hydraulic motors that run on self-contained batteries, generators, fuel cells, or engines. The mechanism 22 may also draw power from the associated propulsion means. Vibrations can be induced by various means, such as rotating eccentric masses inside the roller; piezo-electric actuators; or hydraulic, pneumatic, or electric actuators that induce vibrations by reciprocating at high speeds.

Figure 7:
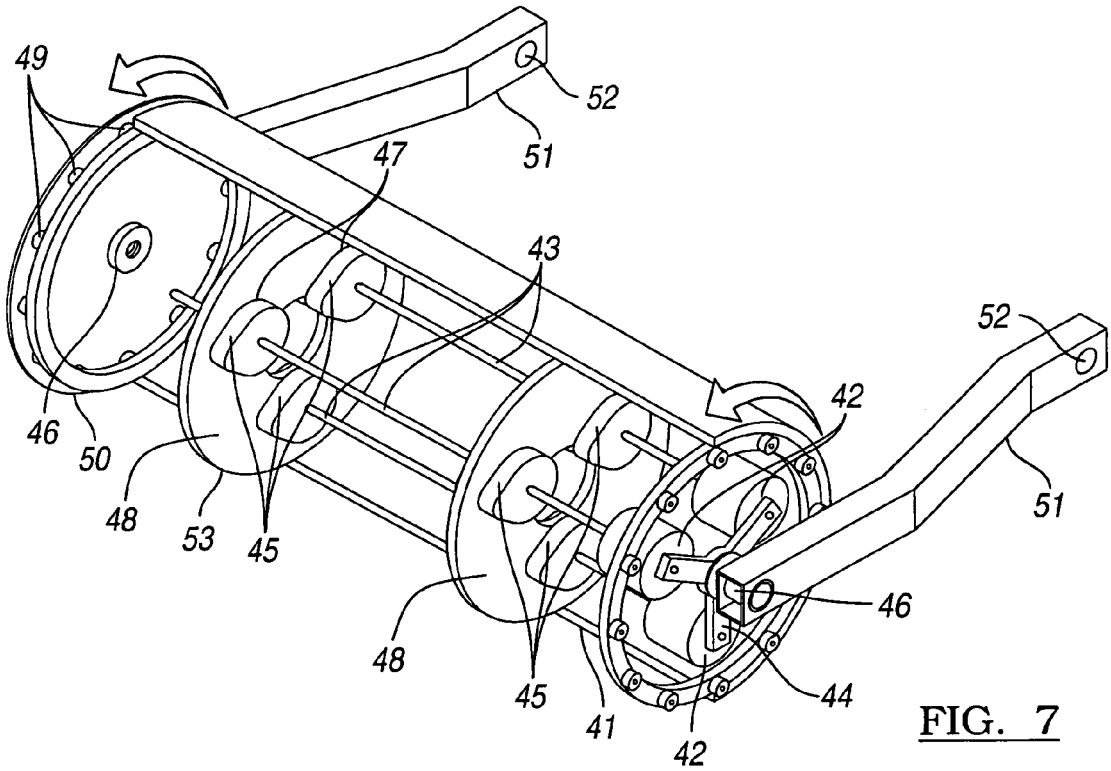
FIG. 7 is a cut-away view of an alternate embodiment of a vibratory mine roller according to the present invention.
Figure 8:
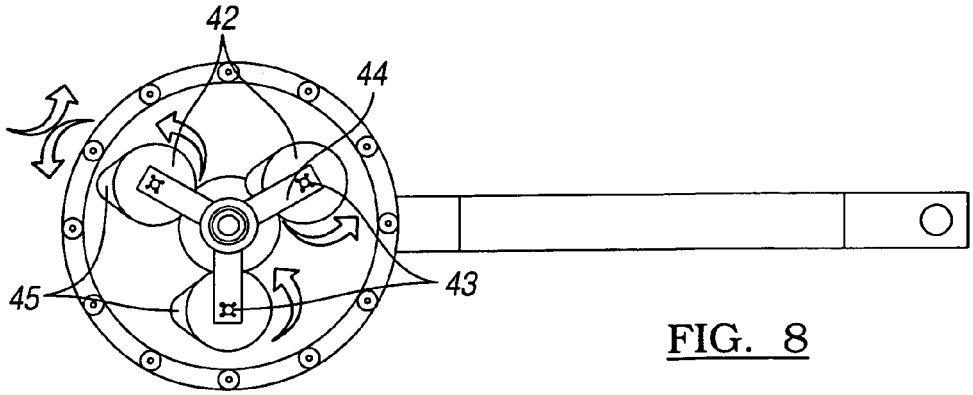
FIG. 8 is a side view thereof.

FIGS. 7-8 show a vibratory system with rotating eccentric weights 45 that spin on multiple shafts 43 may be used for mine clearance and soil compaction.

In this embodiment, the vibratory countermine ground-contacting percussion system includes a roller assembly that is mounted on two support arms 51 that extend outwardly from a mine-clearing propulsion means. The ground-contacting percussion system is mounted on bearings 46 at the ends of the support arms 51, thereby allowing the assembly to freely rotate as it is pushed forward along the ground. The support arms 51 are also allowed to pivot at two bearings or revolute joints 52.

The ground-contacting percussion system contains an internal assembly that includes several rotating, vibratory elements. A minimum of three rotating, vibratory elements is required. Each element has a rotating shaft 43 that has several eccentric weights 45 mounted to it. Each shaft is turned by a means for turning, such as an independent rotary motor/actuator 42 that is driven by hydraulic, electric, or pneumatic power. As each shaft rotates, the eccentric weights 45 produce cyclical vibrations and/or forces that are transmitted into the mine roller through the bearings 47 that support the rotating shafts 43. Preferably, the shaft bearings 47 are mounted to support plates 48 that interface with the roller through additional bearings. Thus, the induced vibrations are transmitted radially and tangentially into the roller, which is still allowed to rotate about its longitudinal axis, independently of the internal vibratory subassembly.

In one embodiment, all rotating vibratory elements 42, 43, 45, 47 are synchronized with each other for speed and angular position of the eccentric weights. Angular position of the entire subassembly is adjustable with respect to the support arms and frame. This angular position is adjusted by rotation of the rotor mount plates 44.

By adjusting various parameters of the vibratory system, the size and direction of the resultant vector of the transmitted vibrations are altered. The vibrations are transmitted through the ground-contacting percussion system and into the soil. They can be directed either straight into the ground, or at some forward angle to allow the energy to be directed at land mines ahead of the contact area.

In one embodiment, sensors 53 are imbedded in the surface of the ground-contacting percussion system to measure soil hardness and/or soil impedance. The impedance measurement is used in a feedback control system (FIGS. 11-12) to adjust the frequency of the vibrations in order to maximize the amount and direction of their propagation into the ground. By optimizing the magnitude and direction of detonating forces, land mines are exploded at some distance ahead of the contact area, thus improving the mine-clearing efficiency while improving the survivability of the mine ground-contacting percussion system and its host propulsion means.

The embedded sensors 53 measure soil hardness and allow a determination to be made of the effective contact surface area between the roller and the soil. This effective contact surface area determines the optimum angular position of the vibratory assembly, adjusted through the rotor mount plates 44. Adjustment of this angular position takes advantage of the surface contact area available (determined by soil hardness, etc.) to allow the transmitted vibrational energy to be directed in the optimum direction.

Figure 9:
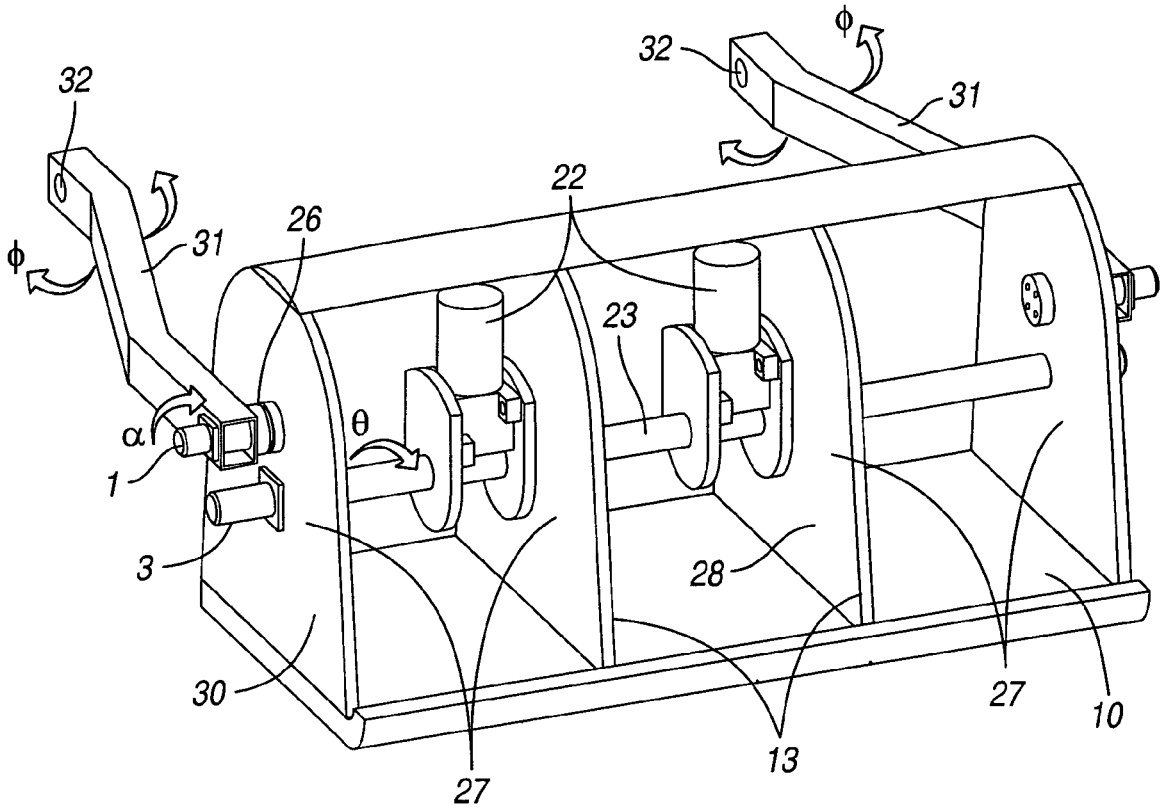
FIG. 9 is a cut-away view of another alternate embodiment of a vibratory mine detonation-percussion system according to the present invention.
Figure 10:
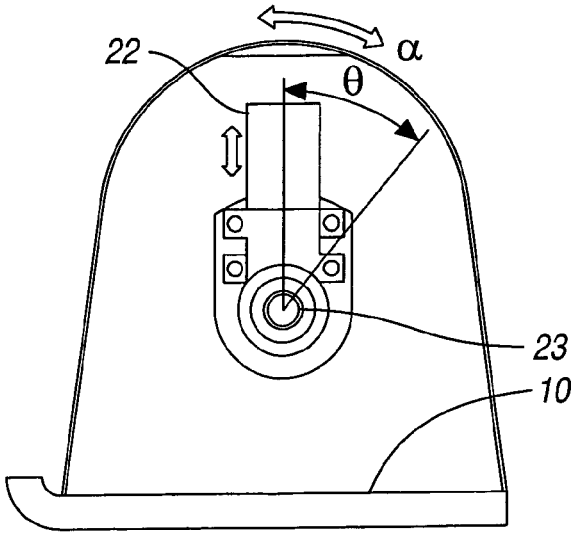
FIG. 10 is a side view thereof.

Reference was made earlier to an invention including a ground-contacting percussion system such as a pad. One such embodiment is depicted in FIGS. 9-10.

Unlike the other "roller" concepts, this alternate configuration uses a flat or curved plate (10) to transmit force and vibration into the ground. This plate, or contact pad, may be contoured in various shapes, and may have a dimpled surface with protrusions.

Frame members (31) link the link the vibratory plate assembly to the propulsion means through support arm pivots (32). The vibratory plate assembly is provided with end plates (30), through which it is mounted to the frame members (31) by roller bearings (26).

The frame members (31) are able to pivot up and down through angle Ø. The vibratory plate assembly is able to pivot through angle $\alpha$, with respect to the support arms (31), through the end bearings (26). In one embodiment, this angular position $\alpha$ is controlled through a rotary actuator and/or motor (1). This allows adjustment and control of the angle of attack of the vibratory plate assembly as it contacts the ground. The plate assembly includes a vibratory sub-assembly, mounted to a shaft (23), extending the length of the plate assembly. This shaft (23) is mounted by bearings (27) in the end plates (30) and in the internal structural ribs (28). The vibratory subassembly with reciprocating actuators (22) are arcuately positioned in relation to associated internal structural ribs (28) and the end plates (30), being able to pivot through angle $\theta$. This angle $\theta$ is adjusted by a rotary actuator (3).

Sensors (13) may be embedded in the surface of the ground-contacting plate to measure soil hardness and/or soil impedance, similar to that depicted in FIG. 7.

Figure 11:
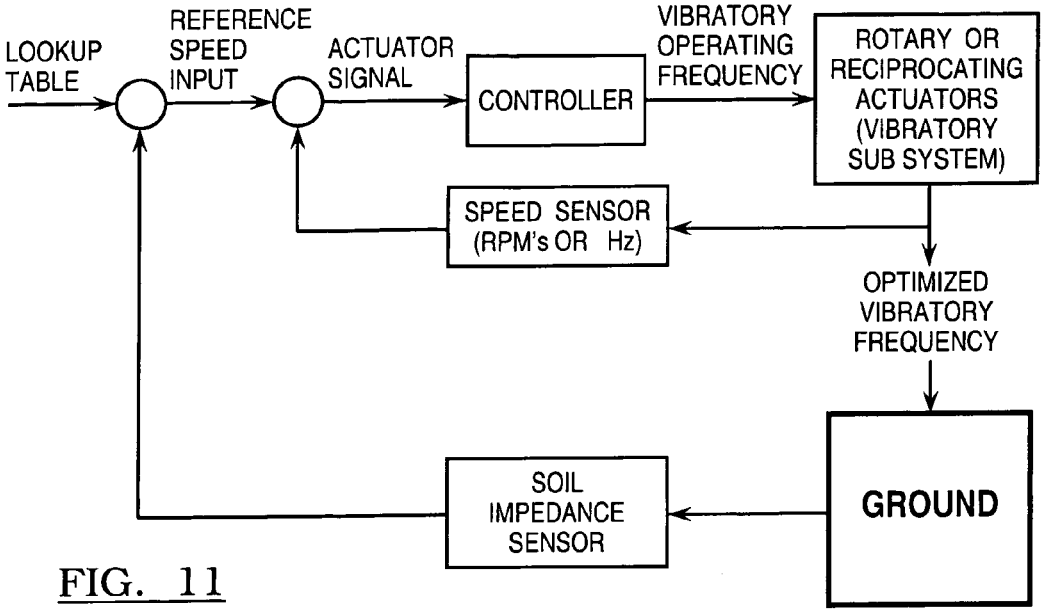
FIG. 11 is a schematic diagram of a feedback control system used to optimize the operating frequency of transmitted vibrations.

In FIG. 11, vibratory frequency is optimized based on soil impedance. The goal is to maximize the transmissibility of force and vibrations into the ground. A database look-up table gives the optimum vibrating frequency versus soil condition (impedance). One or more soil impedance sensors is embedded into the mine roller surface. Preferably, the soil impedance sensors are wireless and transmit an RF signal to a controller. The sensors use low-frequency signals to measure soil impedance.

Figure 12:
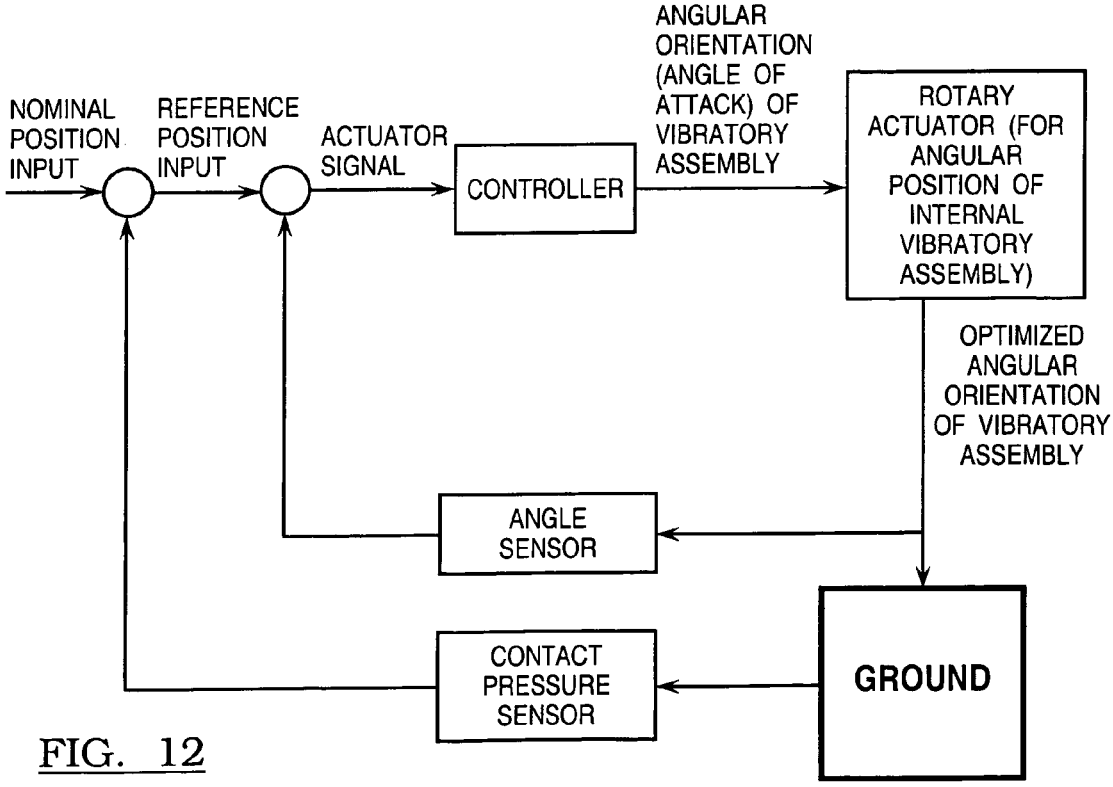
FIG. 12 is a schematic diagram of a feedback control system that is used to optimize the "angle of attack" of a vibratory subassembly.

In FIG. 12, the goal is to optimize the orientation ("angle of attack") of the transmitted load vector, thereby transmitting force and vibration ahead of the mine roller to maximize the stand-off distance. As in FIG. 11, there is an embedded wireless RF sensor on the surface of the roller. The sensor measures the size of the contact "patch" between the roller and the ground, thus determining a maximum allowable angle of attack. The "reference position" input signal is determined by altering the nominal (vertical) angle of attack according to the measured contact patch.

The speed of the vibration subassembly is controlled manually by a remote user, or automatically through computer algorithms. This allows the user to control the frequency of induced vibrations. The magnitude of the induced vibrations is controlled independently of the speed control by varying the input signal to the vibration actuators, or by using additional actuators to vary the radial position of eccentric masses that are mounted to the vibration mechanism.

In one embodiment, a roller assembly also includes sensors that measure and record the magnitude of the force, vibrations, or pressure that are transmitted into the ground by the roller. Thus, the feedback control systems (FIGS. 11-12) optimize or maximize the amount of excitation that is transmitted into the ground for landmine detonation. This is accomplished by measuring the impedance of the current soil or ground conditions, and continuously adjusting the frequency and/or magnitude of the vibrations produced by the roller.

Thus, the invention allows the vibrations or pressure wave to be projected forwardly, at an angle, to detonate mines ahead of the device. The direction of the vibration forces can be controlled by combining multiple excitation forces, or by using an adjustable linear actuator.

Experimental Procedure & Observations

One vibratory mine roller concept has been demonstrated in preliminary lab tests. The results demonstrate enhanced mine-clearing effectiveness by the addition of a vibratory mechanism.

Figure 13:
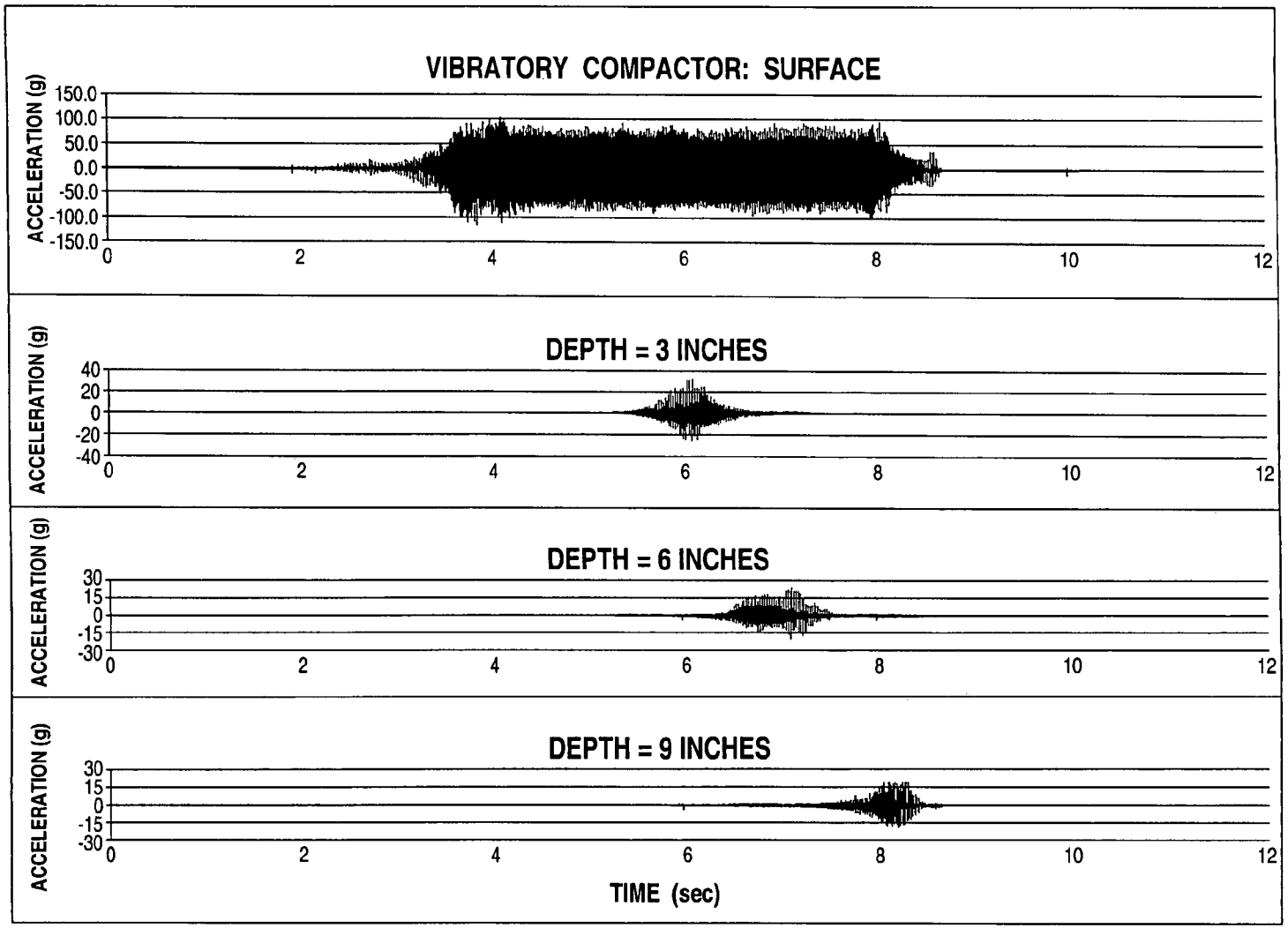
FIG. 13 is a graph of transmitted vibrations (acceleration) measured at simulated land mines buried at various depths. The time histories for each channel are super-imposed on this graph, showing acceleration amplitudes.

In one case, the test setup consisted of 3 instrumented, simulated landmines about 18" apart. One was buried 3" deep, the second at 6" deep, and the third at 9" deep. A handheld vibratory compactor was run across the surface of the soil, over the buried pieces. FIG. 13 shows the results of one test trial. This plot shows the transmitted vibrations (acceleration) measured at simulated land mines buried at various depths. The time histories for each channel are superimposed on this graph, showing acceleration amplitudes.

Table 1, below, summarizes the peak acceleration values for each data channel. At a depth of 9", the simulated landmine sees about 20% of the acceleration values measured directly on the surface compactor (considering overall peak-to-peak values). The shallowest simulated landmine (3" deep) sees about 26% of the acceleration values measured on the surface compactor.

TABLE 1

| Peak Accelerations - Vibratory Compactor Test | | |
|---|---|---|
| Data Channel | Maximum Acceleration (g) | Minimum Acceleration (g) |
| compactor | 104.13 | −112.99 |
| 3" deep | 31.58 | −25.13 |
| 6" deep | 23.33 | −19.49 |
| 9" deep | 19.68 | −19.49 |

Additional test trials were run in various soil conditions, including several trials in which the unpowered compactor was run across the surface of the test bed with no vibrations. As expected, there was a significant difference between running with or without vibration. The dynamic forces transmitted through the sand due to vibratory excitation were up to 50 times greater than the forces transmitted with no vibration. In contrast, most current mine rollers rely solely on the static weight of the roller.

The performance goals of this invention include a system with a stand-off capability of >1 m. The mine clearance operational tempo/neutralization effectiveness will be at least 90% @ 16 kph, with a desired goal of 90% @ 24 kph. The mine blast survivability will exceed 4 TM-62 AT mines, with a desired goal of 8 TM-62 AT mines. Finally, the invention will achieve these goals at a weight of 1 to 3 tons, but will be more effective than the 10-ton rollers currently in use.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A vibratory countermine system associated with a propulsion means that moves the system forwardly, the system comprising:

a ground-contacting percussion system that is mounted at the front of the propulsion means, the system including one or more rollers; and a vibratory subassembly positioned at least partially inside the ground-contacting percussion system assembly for inducing vibrations therein, wherein the vibratory subassembly includes at least three rotating vibratory elements, each element having a rotating shaft with a plurality of eccentric weights mounted thereupon, at least some of the shafts being driven by means for turning, the eccentric weights producing vibrations as the associated shafts rotate, forces thereby being transmitted into the around-contacting percussion system which may rotate about its longitudinal axis independently of the vibratory subassembly;

the ground-contacting percussion system assembly being in contact with terrain or obstacles ahead of the propulsion means and transmitting vibrations, associated forces, and pressure waves below or ahead of the ground-contacting percussion system assembly, thereby inducing the detonation of land mines.

2. The vibratory countermine system of claim 1, further including means for inducing vibrations in the ground-contacting percussion system assembly.

3. The vibratory countermine system of claim 2, wherein the means for inducing vibrations also includes an apparatus selected from the group consisting of additional rotating eccentric masses, piezo-electric actuators, hydraulic actuators, pneumatic actuators, and electric actuators that induce vibrations by reciprocating at high speeds.

4. The vibratory countermine system of claim 2, wherein the means for inducing vibrations can be displaced arcuately in relation to an imaginary vertical axis so that a resultant vector produced by a downwardly acting component of weight plus a forwardly directed vector of induced vibration is directed forwardly and downwardly, thereby detonating land mines located ahead of the ground-contacting percussion system.

5. The vibratory countermine system of claim 2, further including means for articulation that couples with the frame of the propulsion means, the articulation means allowing movement of the ground-contacting percussion system, thereby permitting a freedom of movement that allows the ground-contacting percussion system to maintain continuous or intermittent contact with the ground over varying terrain.

6. The vibratory countermine system of claim 5, further including bump stops that extend from the means for articulation that constrain excessive angular movement of the frame in order to minimize damage to the propulsion means.

7. The vibratory countermine system of claim 1, further including a frame that supports the ground-contacting percussion system assembly, the ground-contacting percussion system assembly being attached to the frame, the frame being coupled to the propulsion means that pushes the ground-contacting percussion system assembly forwardly along the ground ahead of the propulsion means.

8. The vibratory countermine system of claim 7, further including means for retracting the frame, the means for retracting allowing the ground-contacting percussion system to be stowed while navigating through rough terrain or around obstacles, or at high speeds during road travel.

9. The vibratory countermine system of claim 1, wherein the ground-contacting percussion system assembly includes multiple rollers that move independently of each other, thereby allowing improved mine-clearing coverage and mobility over uneven or undulating terrain.

10. The vibratory countermine system of claim 9, wherein the multiple rollers comprise one or more groups of rollers.

11. The vibratory countermine system of claim 10, wherein at least one of the one or more groups of rollers comprises three rollers.

12. The vibratory countermine system of claim 1, further including means for powering the vibratory subassembly.

13. The vibratory countermine system of claim 12, wherein the means for powering includes one or more generators, fuel cells, engines or motors that run on batteries.

14. The vibratory countermine system of claim 12, wherein the means for powering is provided by a source of power associated with the propulsion means.

15. The vibratory countermine system of claim 1, wherein an angular position of the subassembly is adjustable with respect to a frame that supports the ground-contacting percussion system ahead of the propulsion means.

16. The vibratory countermine system of claim 15, further including one or more sensors that are embedded in the ground-contacting percussion system, the sensors measuring soil hardness and/or soil impedance.

17. The vibratory countermine system of claim 16, wherein the one or more sensors generate a signal in accordance with impedance measured, the signal being directed to a feedback control system that adjusts the frequency of vibration so as to maximize the transmissibility into the ground.

18. The vibratory countermine system of claim 1, wherein the ground-contacting percussion system includes one or more ground-contacting pads that trample on the ground below or ahead of the vibratory subassembly.

19. A method for detonating mines below or ahead of a vibratory countermine ground-contacting percussion system, comprising the steps of:

mounting a roller assembly at the front of a propulsion means;

positioning a vibratory subassembly at least partially inside the roller assembly for inducing vibrations therein;

providing at least three rotating vibratory elements associated with the vibratory subassembly, each element having a rotating shaft with a plurality of eccentric weights mounted thereupon, each shaft being driven by means for turning, the eccentric weights producing vibrations as the associated shafts rotate, forces thereby being transmitted into the ground-contacting percussion system which may rotate about its longitudinal axis independently of the vibratory subassembly; and arcuately displacing the vibratory subassembly within the ground-contacting percussion system so that a resultant force is directed forwardly and downwardly ahead of the propulsion means, thereby detonating mine positions ahead thereof.

* * * * *